US006115560A

United States Patent [19]

Kuek et al.

[11] Patent Number: 6,115,560

[45] Date of Patent: Sep. 5, 2000

[54] APPARATUS AND METHOD FOR AUTOMATIC ADJUSTMENT OF PRE-CLEAN COROTRON CURRENT

[75] Inventors: Soon Kuan Kuek, Fairport; Bruce Earl Thayer, Webster, both of N.Y.

[73] Assignee: Xerox Corporation, Stamford, Conn.

[21] Appl. No.: 09/449,351

[22] Filed: Nov. 24, 1999

[51] Int. Cl.[7] ..... G03G 21/00

[52] U.S. Cl. ..... 399/45; 399/71; 399/343; 430/125

[58] Field of Search ..... 399/45, 9, 71, 399/343, 349; 430/125, 937

[56] References Cited

U.S. PATENT DOCUMENTS 4,133,610 1/1979 Bernardelli et al. .
4,270,485 6/1981 Murasawa et al. ..... 118/648
4,378,421 3/1983 Larson ..... 430/121
4,756,993 7/1988 Kitatani et al. ..... 430/69

*Primary Examiner*—Richard Moses
*Attorney, Agent, or Firm*—Oliff & Berridge PLC

[57] ABSTRACT

Electrostatic printing machines require different types of paper with different width and thickness. In relation to the paper thickness and width is a phenomenon called the End Leakage Current Effect whereby highly positive voltage can be found in the non-paper contact area of a photoreceptor surface after the transfer stage. The paper transfer stage is when the paper touches the photoreceptor and an image is transferred onto the paper. This effect can result in cleaning failure and potential non-uniformity on the photoreceptor surface. The extent of the end leakage current effect depends on the thickness and width of the paper to which the image is being transferred. Adjusting the pre-clean corotron current based on paper thickness and width provides a remedy for the end leakage effect. Sufficient corona treatment can be provided to the residual toner to enable proper cleaning of the photoreceptor when the pre-clean corotron current is adjusted accordingly.

18 Claims, 7 Drawing Sheets

APPARATUS AND METHOD FOR AUTOMATIC ADJUSTMENT OF PRE-CLEAN COROTRON CURRENT

BACKGROUND OF THE INVENTION

1. Field of Invention

The present invention relates generally to preventing electrical potential non-uniformity on a photoreceptor surface.

2. Description of Related Art

In a typical electrostatographic printing process, printing is initiated by selectively charging and/or discharging a charge receptive imaging member, e.g., a photoreceptor, in accordance with an original input document or an imaging signal, thereby generating an electrostatic latent image on the imaging member. This latent image is subsequently developed into a visible image by a process in which a charged developing material is deposited onto the surface of the latent image bearing imaging member. The charged particles in the developing material adhere to image areas of the latent image to form a visible developed image corresponding to the latent image on the imaging member. The developed image may be subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The developing material typically comprises carrier granules having toner particles adhering electrically thereto, wherein the toner particles are electrostatically attracted from the carrier granules to the latent image areas to create a powder toner image on the imaging member. Alternatively, the developing material may comprise a liquid developing material comprising a carrier liquid having pigmented marking particles, or "toner solids," and charge director materials dispersed and/or dissolved therein. When the liquid developing material is applied to the latent image bearing imaging member, the marking particles are attracted to the image areas of the latent image to form a developed liquid image. Regardless of the type of developing material employed, the toner or marking particles of the developing material are uniformly charged and are electrostatically attracted to the latent image.

The above-described electrostatographic printing process is well known and has been implemented in various forms in the marketplace to facilitate, for example, light lens copying of an original document, as well as printing of electronically generated or digitally stored images where the electrostatic latent image is formed via a modulated laser beam.

In an ionographic device, an ion producing device generates ions to be directed past a plurality of modulation electrodes to a charge receptive imaging member, e.g., charge receptor or photoreceptor. The ions are deposited on the charge receptor in an image-wise configuration to form an electrostatic latent image that may be developed directly on the charge receptor. A final substrate to be output, such as dielectric paper, may be used as the charge receptor, thus eliminating the need for a subsequent transfer of the developed image to a final output product. Alternatively, a drum, a belt, or the like, coated with insulating dielectric film may be used as the charge receptor. In this situation, the developed image is subsequently transferred from the charge receptor to a final substrate.

Analogous processes also exist in other electrostatic printing systems wherein a charge carrying medium is adapted to carry an electrostatic latent image. The typical electrostatographic printing process includes a development step whereby developing material is physically transported into contact with the imaging member so as to selectively adhere to the latent image areas thereon in an image-wise configuration. As discussed above, development of the latent image is usually accomplished by electrical attraction of the toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material, referred to as charged area development (CAD), or "write white" systems. Other printing processes operate in a manner such that discharged areas attract developing material, referred to as discharged area development (DAD), or "write black" systems.

As discussed above, in one electrostatic printing technique, latent electrostatic images are formed on a photoreceptor and are developed by a suitable toner material to render the images visible. The images are subsequently transferred to plain paper of various widths and thickness.

SUMMARY OF THE INVENTION

Electrostatic printing machines allow for different types of paper with different widths and thickness. In proportion to the paper thickness and width is a phenomenon called the "End Leakage Current Effect" whereby a highly positive voltage can be found in the non-paper contact area of a photoreceptor surface after transfer. Transfer occurs when the paper touches the photoreceptor and an image is transferred onto the paper. The extent of the end leakage current effect depends on the thickness and width of the paper to which the image is being transferred. This effect can result in cleaning deficiencies and an electrical potential non-uniformity on the photoreceptor surface.

This invention provides systems and methods for automatically adjusting the pre-clean corotron current based on paper thickness and width.

This invention separately provides systems and methods for providing sufficient corona treatment to any residual toner to enable proper cleaning.

This invention separately provides systems and methods for adjusting the negative pre-clean current to a higher value thereby neutralizing the positive voltage on the non-paper photoreceptor surface.

These and other features and advantages of this invention are described in or are apparent from the following detailed description of this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
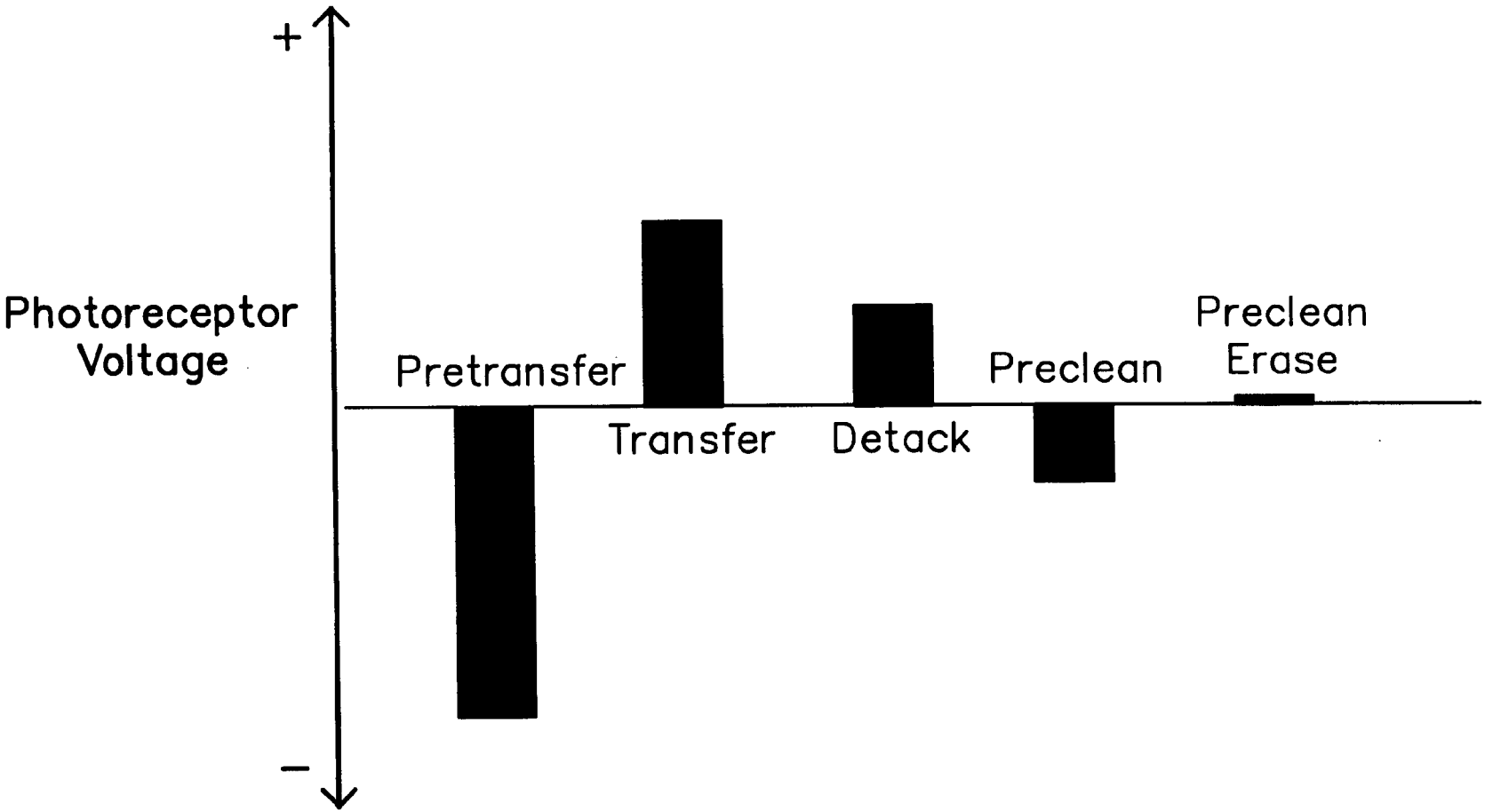
FIG. 1 illustrates a photoreceptor voltage in a non-paper contact area without an end leakage current during an electrostatographic printing process in accordance with the systems and methods of the invention.

For a general understanding of the features of the present invention, reference is made to the drawings, wherein like reference numerals have been used throughout to identify identical or similar elements. While the present invention will be described in terms of an illustrative embodiment or embodiments, it will be understood that the invention is adaptable to a variety of copying and printing applications, such that the present invention is not necessarily limited to the particular embodiment or embodiments shown and described herein. To the contrary, the following description is intended to cover all alternatives, modifications, and equivalents, as may be included within the spirit and scope of the invention. Specifically, it will be understood that the instant invention applies to all various types of electrostatic printing systems and is not intended to be limited by the manner in which the image is formed on the imaging member or the nature of the latent image bearing member itself.

In the electrostatographic printing process, corona devices are needed. A corona device is used to spray a certain amount of ions onto a substrate, e.g., paper, and onto a photoreceptor so that toner, on the photoreceptor can be transferred onto the paper. However, because the size of the photoreceptor is usually fixed and the size of paper is variable, e.g., smaller than the photoreceptor, when a corona device, a corotronotran, sprays ions onto the photoreceptor surface, excess ions can be deposited onto the photoreceptor surface. When the paper is removed from the photoreceptor after the ions are sprayed, there may be an excess of ions on the non-paper contact area of the photoreceptor, creating non-uniformity of charges on the photoreceptor, resulting in an end leakage current effect.

Corotrons are used in many places in a machine. For illustrative purposes, this invention will be described with reference to corotrons at pre-transfer, transfer, and pre-clean. Due to high pre-transfer and transfer corotron currents in some copiers and printers, a high positive voltage can be deposited on the surface of the paper and the non-paper contact area of the photoreceptor at pre-transfer and transfer. Following paper detack and stripping, part of the photoreceptor can have a highly positive charge, e.g., within the non-paper contact area, and part of the photoreceptor can have a zero or a negative charge, e.g., within the paper contact area.

FIG. 1 illustrates a photoreceptor voltage in a non-paper contact area when there is no end leakage current during an electrostatographic printing process in accordance with the systems and methods of the invention. At the pre-transfer step, a corotron is used to condition the photoreceptor with mostly negative ions. Then, at the transfer step, the paper touches the photoreceptor and the image is transferred to the paper with the aid of a transfer corotron which conditions the paper with mostly positive ions to attract negatively charged toner to paper. At the detack step, the paper leaves the photoreceptor with the toner image transferred to the paper. When the paper leaves the photoreceptor, residual toner can be left on the photoreceptor. Toner tends to be charged negatively. However, when the paper is stripped away from the photoreceptor, there can be a break down of ions causing the residual toner to have mixed charges, e.g., positive and negative charges. This residual toner is preferably cleaned by the cleaning subsystem.

The cleaning subsystem may have two parts. The first part of the cleaning subsystem is the pre-clean step with a pre-clean corotron. The pre-clean corotron sprays negative ions on the residual toner so that the mix-charged toner is conditioned to be negative. This negative conditioning enables the electrostatic brushes in the system to remove the negative toner. Preferably, one of the electrostatic brushes is charged positively, therefore, the positive brush picks up the negative toner and sends it to a waste dump. By spraying mostly negative ions, the pre-clean corotron also conditions the photoreceptor to a negative state. FIG. 1 shows how the pre-clean corotron current step is able to change the photoreceptor voltage from positive to negative at pre-clean. Following the pre-clean corotron treatment is a pre-clean erase step that cleans the negative charges off of the photoreceptor using an erase lamp. At this step, the photoreceptor should preferably be returned to a neutral state before the cycle begins again.

Figure 2:
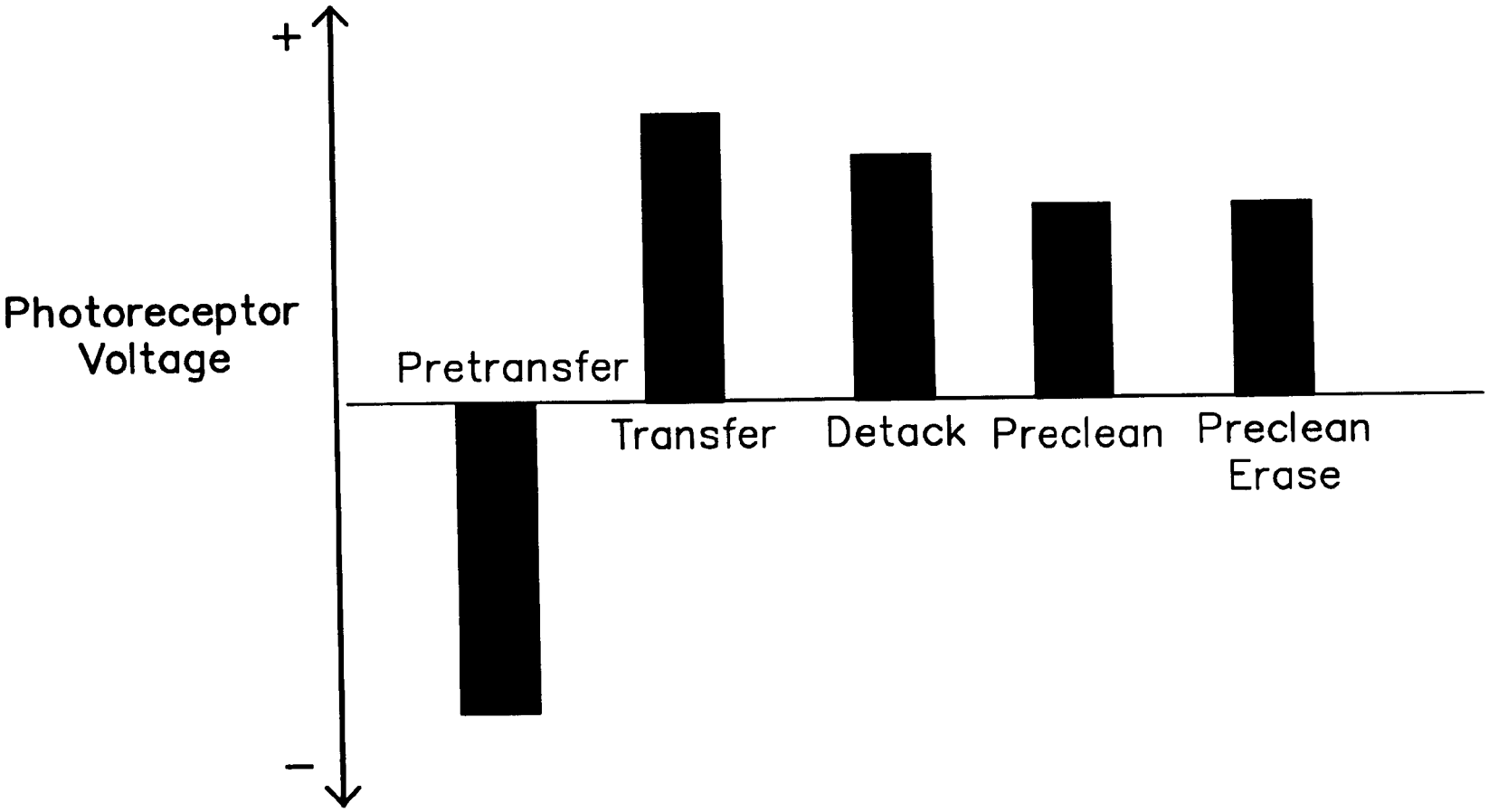
FIG. 2 illustrates a photoreceptor voltage in a non-paper contact area with an end leakage current during an electrostatographic printing process in accordance with the systems and methods of the invention.

FIG. 2 illustrates the photoreceptor voltage in a non-paper contact area when there is an end leakage current during an electrostatographic printing process in accordance with the systems and methods of the invention. As illustrated above, at the pre-transfer step, a corotron is used to condition the photoreceptor with mostly negative ions. Then, at the transfer step, the paper touches the photoreceptor and the image is transferred to the paper with the aid of a transfer corotron which conditions the paper with mostly positive ions to attract negatively charged toner to the paper. An End leakage current effect occurs when the paper/substrate used is thicker and narrower than the width of the photoreceptor. Due to the thicker paper, higher corotron current will be needed at the transfer step to provide more positive ions to the paper. As a result, the non-paper contact area of the photoreceptor, adjacent to the paper, will also be charged with more positive ions. At the detack step, the paper leaves the photoreceptor with the image transferred on the paper.

Following the detack step, different voltages are found on the photoreceptor surface across the width of the photoreceptor. In the image area where there had been paper contact, the photoreceptor voltage is expected to be close to zero, depending on the thickness of the paper. In the non-image/non-paper contact area, the photoreceptor voltage can be highly positive. This non-uniformity of potential on the photoreceptor surface illustrates the end leakage current effect. This voltage difference between the paper and non-paper contact areas on the photoreceptor surface is not constant, it depends on the width and thickness of the paper. Therefore, higher differences are expected with variations in thicker and narrower papers.

The pre-clean corotron treatment step can only decrease the charges on the photoreceptor to a degree. If highly positive charges exist, the pre-clean corotron can only reduce the current down to a less positive state as the pre-clean step shows in FIG. 2. Thus, the pre-clean corotron current step may not be able to shift the charge of the photoreceptor into the negative photoreceptor voltage region. As a result, there may be little difference between the charge on the photoreceptor between the pre-clean step and pre-clean erase step.

Due to the excessive positive voltage on the non-paper contact area during the end leakage current effect, most of the negative current from the pre-clean corotron is drawn to the non-image/non-paper contact area on the photoreceptor surface. This results in little pre-clean corona treatment of the image area where the residual toner may be located. Since the residual toner is of mostly mixed polarity, it cannot be picked up by a positively biased cleaning brush. As a result, the reduced corona treatment results in a cleaning failure. In addition, the voltage difference across the photoreceptor causes non-uniformity issues during copy production as the belt comes to the charging station since the pre-clean erase step cannot eliminate the positive voltage.

Figure 3:
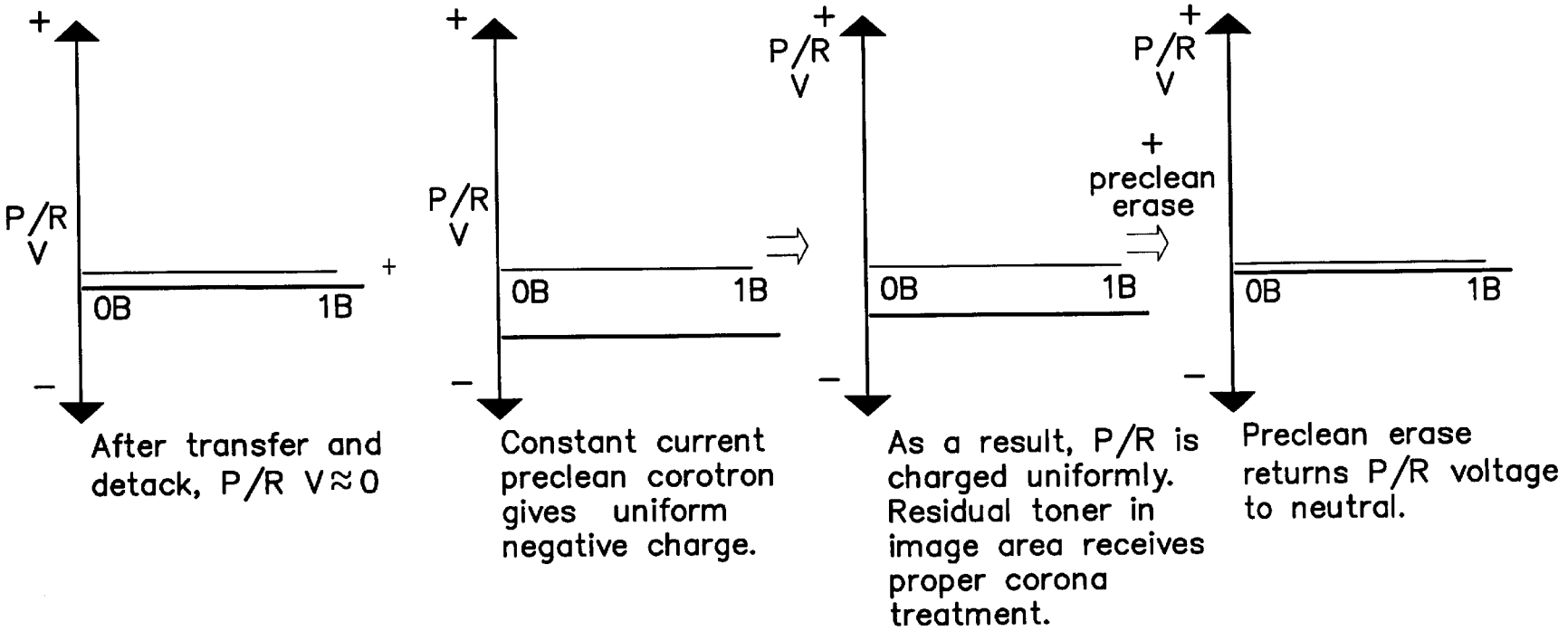
FIG. 3 illustrates a photoreceptor voltage without an end leakage current between an out-board and an in-board area of an electrostatographic device in accordance with the systems and methods of the invention.

FIG. 3 illustrates a photoreceptor voltage without an end leakage current between an out-board and an in-board area of an electrostatographic device in accordance with the systems and methods of the invention. After the transfer step and detack step, the photoreceptor voltage is preferably approximately zero in the paper and non-paper contact areas. A constant current pre-clean corotron gives a uniform negative charge to the hotoreceptor. As a result, the photoreceptor is uniformly charged. Any residual toner in the image area receives a proper corotron treatment. In addition, the pre-clean erase step returns the photoreceptor voltage to neutral by discharging the negatively charged photoreceptor using an erase lamp. This creates uniformity in the photoreceptor's profile. Thus, the quality production of the next image is maintained.

Figure 4:
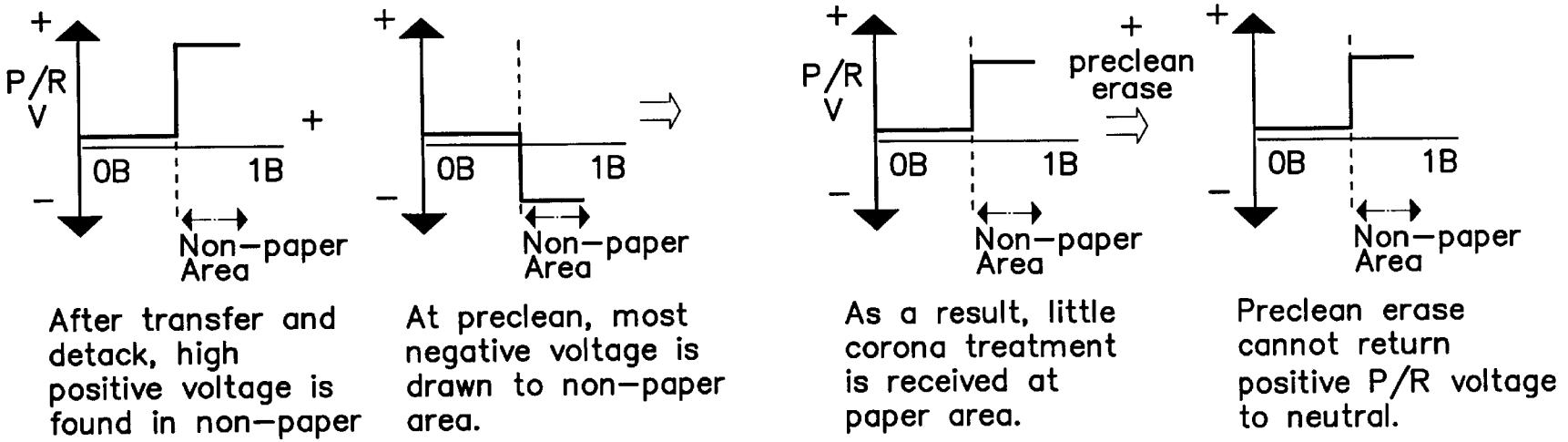
FIG. 4 illustrates a photoreceptor voltage with an end leakage current between an out-board and an in-board area of an electrostatographic device in accordance with the systems and methods of the invention.

FIG. 4 illustrates a photoreceptor voltage with an end leakage current between an out-board and an in-board area of an electrostatographic device in accordance with the systems and methods of the invention. After the transfer step and the detack step, a high positive voltage is found in the non-paper contact area of the photoreceptor. At the pre-clean step, most of the negative voltage is drawn to the non-paper contact area. As a result, little corotron treatment is received at the paper contact area. Thus, the mix-charged residual toner in the image area cannot receive a proper corotron treatment. In addition, the pre-clean erase step cannot return the photoreceptor's voltage to neutral since an erase lamp cannot discharge a positively charged photoreceptor. Therefore, the photoreceptor remains highly positive charged in the non-paper contact area. For example, part of the photoreceptor is highly positive and part of the photoreceptor is zero or negative. The photoreceptor's profile is non-uniform in this scenario which results in image density disparity.

Figure 5:
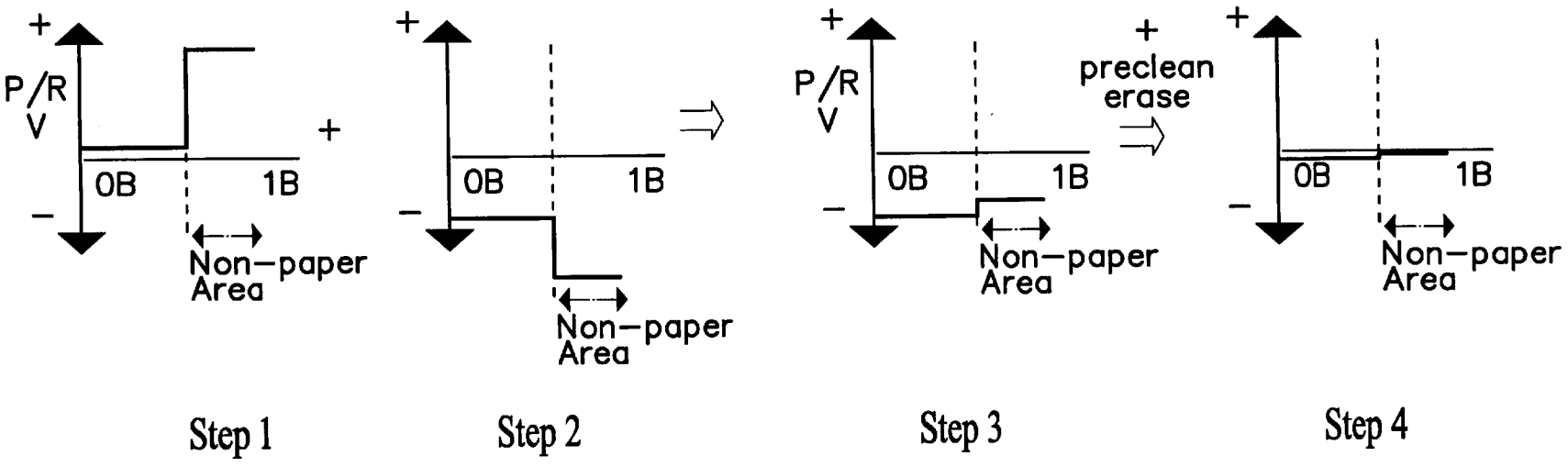
FIG. 5 illustrates an exemplary automatic adjustment method to remedy the end leakage effect in accordance with the systems and methods of the invention.

FIG. 5 illustrates an exemplary automatic adjustment method to remedy the end leakage effect in accordance with the systems and methods of the invention. In step 1, after the transfer step and the detack step, a high positive voltage is found in the non-paper contact area as a result of paper thickness and/or width. The non-paper contact area is adjacent to the in-board area of the photoreceptor. The paper contact area is adjacent to the out-board area, wherein the photoreceptor's voltage is slightly positive.

In step 2, the pre-clean corotron current, upon the system detecting a thick and/or narrow paper, is adjusted to a higher level. Most of the negative voltage on the photoreceptor is then drawn to the non-paper contact area adjacent to the in-board area of the photoreceptor. However, sufficient negative voltage is preferably still available in the paper contact area adjacent to the out-board area of the photoreceptor. The pre-clean corotron current is adjusted to lower the photoreceptor's voltage to a negative level in both the paper and non-paper contact areas of the photoreceptor.

In step 3, the pre-clean step enables the high positive voltage in the non-paper contact area adjacent to the in-board area of the photoreceptor to be neutralized or biased into the negative region while sufficient corotron current treatment is received in the paper contact area adjacent the out-board area of the photoreceptor. In this step, the pre-clean corotron current has decreased the charges on the photoreceptor to a degree.

In step 4, the pre-clean erase step returns the photoreceptor voltage to neutral since the pre-clean erase is able to remove negative charges remaining on the photoreceptor's surface.

Figure 6:
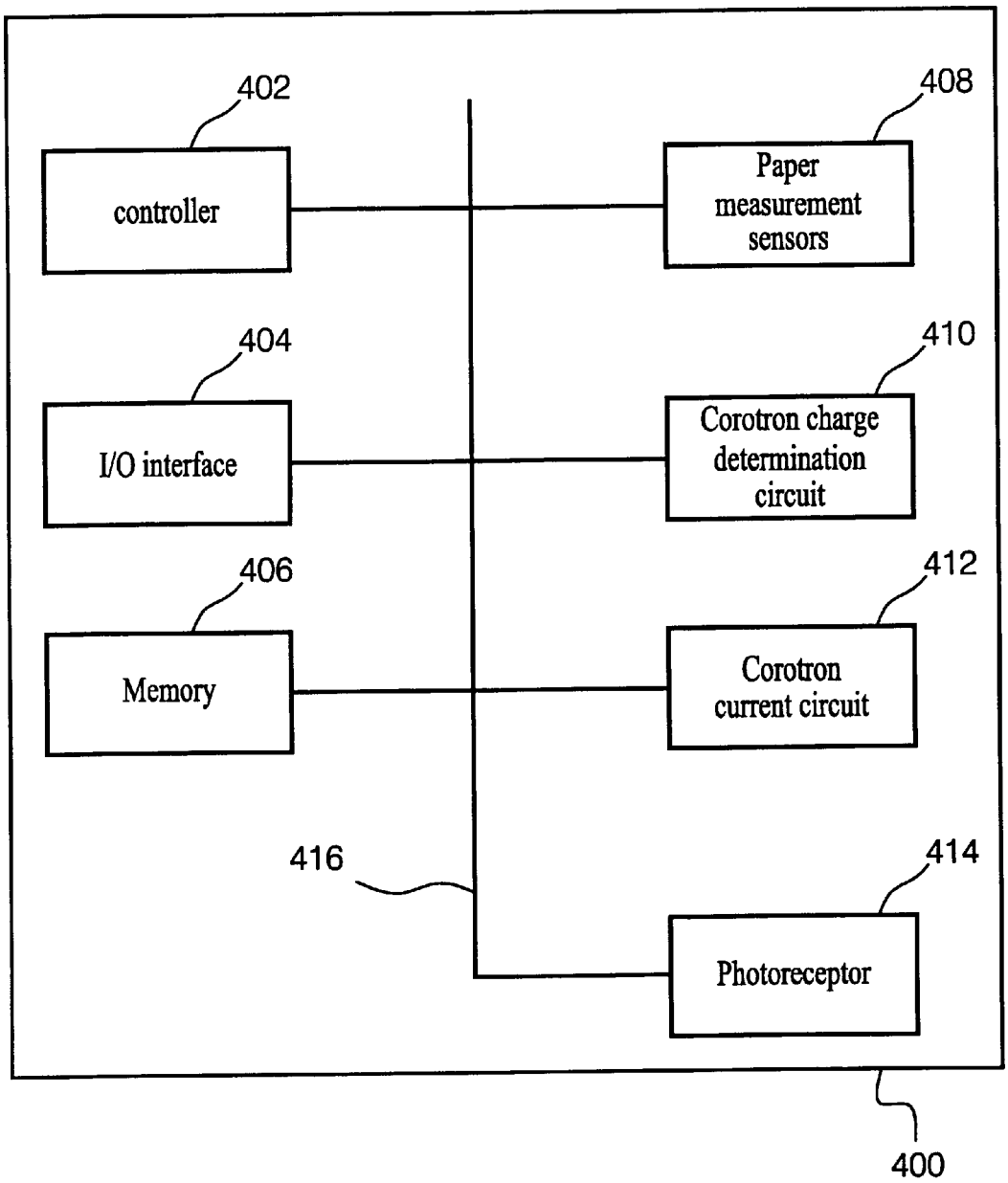
FIG. 6 illustrates an exemplary automatic adjustment device to remedy the end leakage effect in accordance with the systems and methods of the invention.

FIG. 6 illustrates an exemplary automatic adjustment device to remedy the end leakage current effect in accordance with the systems and methods of the invention. The automatic adjustment device 400 includes a controller 402, an I/O interface 404, a memory 406, at least one paper measurement sensor 408, a corotron charge determination circuit 410, a corotron current circuit 412, and a photoreceptor 414. While FIG. 6 shows the controller 402, the corotron charge determination circuit 410, and the corotron current circuit 412 as separate units, the functions performed by these units may be combined or may be further divided among specified processors such as digital signal processors and/or performed by dedicated hardware such as application specific integrated circuits (ASIC) or other hardware implementations integrated into existing printers or photocopiers etc., for example. The above components are coupled together through a control/signal bus 416. While FIG. 6 shows a bus architecture, other hardware configurations may also be possible as is well known in the art.

The at least one paper measurement sensor 408 in FIG. 6 is responsible for detecting the paper thickness and width and for routing this information to the controller 402 via the control/signal bus 416. The at least one paper measurement sensor 408 can include a plurality of capacitance sensors arranged in series at the process transfer stage. Alternatively, the at least one paper measurement sensor 408 can include a single capacitance sensor in the center of the photoreceptor's 414 surface used to detect the paper thickness and a paper size sensor within a paper feed tray to determine the width of the paper.

In one embodiment of the invention, a plurality of capacitance sensors can be added at the transfer stage to measure the dielectric constant of the paper on which the image is to be transferred. In this embodiment, the at least one paper measurement sensor 408 can be arranged in series in the cross process direction. In this arrangement, the at least one paper measurement sensor 408 can detect the thickness and width of the paper based on the dielectric constant measured. However, it should be appreciated that in general any configuration of paper measurement sensors that allow for width and thickness determination of incoming paper can be used equally well with the systems and methods of this invention.

The controller 402 used in the system need not be a single contiguous entity. Instead, the controller can be implemented, at least in part, as a plurality of general purpose data processors and/or a single special purpose integrated circuit (e.g., ASIC) or an array of ASICs each having a main or central processor section for overall, system-level control, and separate sections dedicated to performing various specific computations, functions and other processes under the control of the central processor section. The controller 402 can also be implemented using, or include, a plurality of separate dedicated programmable integrated or other electronic circuits or devices, e.g., hardwired electronic or logic circuits, such as discrete element circuits or programmable logic devices.

The corotron charge determination circuit 410 determines the amount of pre-clean corotron current needed to neutralize the photoreceptor 414. This determination is based on information received from the at least one paper measurement sensor 408 via the control/signal bus 416. Once the determination has been made as to the amount of pre-clean corotron current needed, this information can be fed to the corotron current circuit 412. The corotron current circuit 412 sprays the necessary amount of negative ions onto the photoreceptor 414 in order to bring the photoreceptor 414 to a neutral state.

Figure 7:
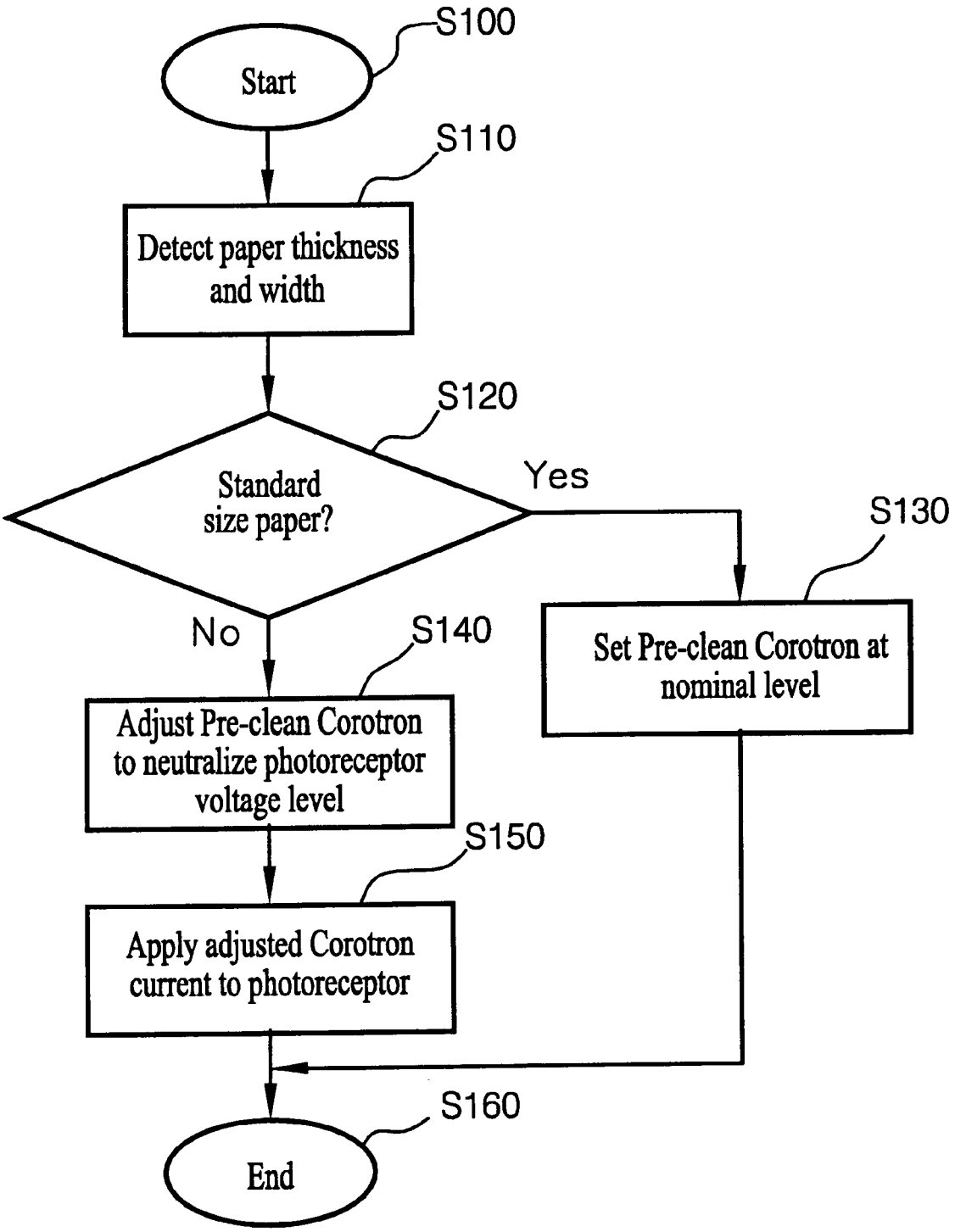
FIG. 7 shows a flowchart outlining one exemplary embodiment of a method for automatically adjusting the corotron current in accordance with the systems and methods of the invention.

FIG. 7 shows a flowchart outlining one exemplary embodiment of the method for automatically adjusting the corotron current in accordance with the systems and methods of the invention. As shown in FIG. 7, the processing process begins in step S100, and continues to step S110, where paper thickness and width are detected. Then in step S120, a determination is made as to whether the paper used is of standard size. This determination can be made by the user, automatically, or a combination of both automatically and by user-input about the paper size.

If, in step S120, the paper size is determined to be standard, control continues to step S130. Otherwise, control jumps to step S140. In step S130, the pre-clean corotron current is set at a nominal level. For example, in Xerox's Constellation® machine the nominal level is at approximately −20 micro-amps. When standard size paper is used, the end leakage current effect is insignificant. Once the pre-clean corotron current is set at a nominal level, control then passes to step S160. In step S160, the process ends.

In step S140, depending on the thickness and width of the paper, the pre-clean corotron current is adjusted to neutralize the photoreceptor's surface voltage level. For example, when an image is transferred to papers thicker than a certain thickness and narrower han a certain width, the pre-clean corotron current can be adjusted to a higher value. For example, in Xerox's Constellation® machine, this higher level is approximately −40 micro-amps. Then, in step S150, the adjusted corotron current is applied to the photoreceptor' surface.

Most of the negative current that is drawn to the non-paper contact area of the photoreceptor neutralizes the positive voltage on the photoreceptor's surface while sufficient corotron current is fed to the image contact area to treat the mixed polarity residual toner. Control then continues to step S160, where the control sequence ends.

As shown in FIG. 6, the automatic adjustment system to remedy the end leakage effect is preferably implemented either on a single program general purpose computer or separate program general purpose computer. However, the automatic adjustment system to remedy the end leakage effect can also be implemented on a special purpose computer, a programmed microprocessor or microcontroller and peripheral integrated circuit element, and ASIC, or other integrated circuit, a digital signal processor, a hardwired electronic or logic circuit such as a discrete element circuit, a programmable logic device such as a PLD, PLA, FPGA, PAL, or the like. In general, any device, capable of implementing a finite state machine that is in turn capable of implementing the flowcharts in FIG. 7 can be used to implement the automatic adjustment system to remedy the end leakage effect.

Furthermore, the disclosed method may be readily implemented in software using object or object-oriented software development environments that provide portable source code that can be used on a variety of computer or workstation hardware platforms. Alternatively, the disclosed automatic adjustment system to remedy the end leakage effect may be implemented partially or fully in a hardware using standard logic circuits or VLSI design. Whether software or hardware is used to implement the systems in accordance with this invention is dependent on the speed and/or efficiency requirements of the system, the particular function, and the particular software or hardware systems or microprocessors or microcomputer systems being utilized. The automatic adjustment system to remedy the end leakage effect and methods described above, however, can be readily implemented in hardware or software using any known or later-developed systems or structures, devices and/or software by those skilled in the applicable art without undue experimentation from the functional description provided herein together with a general knowledge of the computer arts.

Moreover, the disclosed methods may be readily implemented as software executed on a programmed general purpose computer, a special purpose computer, a microprocessor, or the like. In this case, the methods and systems of this invention can be implemented as a routine embedded on a personal computer such as Java® or CGI script, as a resource residing on a server or graphics work station, as a routine embedded in a dedicated search control system, web browser, web TV interface, PDA interface, or the like. The automatic adjustment system to remedy the end leakage effect can also be implemented by physically incorporating the system and method into a software and/or hardware system, such as the hardware and software of a graphics workstation or dedicated search control system.

The invention has been described with particularity in connection with the embodiments. However, it should be appreciated that many alternatives, modifications and variations may be made to the embodiments of the invention without departing from the spirit and inventive concepts contained herein. Accordingly, the present invention is intended to embrace all such alternatives, modifications, and variations.

What is claimed is:

1. A method of adjusting pre-clean corotron current to remedy end leakage current effect on a photoreceptor, the method comprising:

detecting at least one of a paper width and thickness;

determining whether the detected at least one of paper width and thickness is attributable to any end leakage current; and adjusting the pre-clean corotron current to a value sufficient to bring the photoreceptor to a neutral charge if the detected at least one of paper width and thickness is attributable to end leakage current.

2. The method of claim 1, wherein detecting the paper width and thickness comprises measuring a dielectric constant of the paper.

3. The method of claim 2, wherein measuring the dielectric constant comprises measuring the dielectric constant at a paper transfer stage.

4. The method of claim 2, wherein measuring the dielectric constant comprises sensing the paper thickness and the width using capacitance sensors.

5. The method of claim 4, wherein using capacitance sensors comprises arranging the capacitance sensors in series.

6. The method of claim 5, wherein arranging the capacitance sensors in series comprises arranging the capacitance sensors in series in a cross process direction.

7. The method of claim 4, wherein using sensors comprises using at least one capacitance sensor in the center of the photoreceptor width, wherein the paper thickness is determined.

8. The method of claim 7, wherein using sensors comprises using paper size sensors within a paper feed tray to determine the paper width.

9. The method of claim 1, further comprising:

setting the pre-clean corotron current at its nominal level if the paper size is standard.

10. A system for adjusting a pre-clean corotron current to remedy end leakage current effect on a photoreceptor, the system comprising:

a photoreceptor;

a plurality of sensors for measuring at least one of paper thickness and width; and a controller, the controller determining if the at least one of paper thickness and width is attributable to end leakage current based on the measurement from the plurality of sensors and adjusting the pre-clean corotron current to a value sufficient to bring the photoreceptor's voltage to neutral.

11. The system of claim 10, wherein the plurality of sensors detect a dielectric constant of the paper.

12. The system of claim 11, wherein the plurality of sensors detect the dielectric constant of the paper at a paper transfer stage.

13. The system of claim 11, wherein the plurality of sensors are capacitance sensors.

14. The system of claim 13, wherein the capacitance sensors are arranged in series.

15. The system of claim 14, wherein the capacitance sensors are arranged in a cross process direction.

16. The system of claim 13, wherein at least one capacitance sensor is used in the center of the photoreceptor width, wherein the paper thickness is determined.

17. The system of claim 16, wherein paper size sensors are used within a paper feed tray to determine the paper width.

18. The system of claim 10, further comprising:

the controller setting the pre-clean corotron current at its nominal level if the paper size is standard.

* * * * *